US011047343B2

(12) United States Patent
Sugiura

(10) Patent No.: US 11,047,343 B2
(45) Date of Patent: Jun. 29, 2021

(54) EVAPORATED FUEL TREATMENT DEVICE

(71) Applicant: AISAN KOGYO KABUSHIKI KAISHA, Obu (JP)

(72) Inventor: Masanori Sugiura, Toyoake (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 97 days.

(21) Appl. No.: 16/319,919

(22) PCT Filed: Jun. 23, 2017

(86) PCT No.: PCT/JP2017/023268
§ 371 (c)(1),
(2) Date: Jan. 23, 2019

(87) PCT Pub. No.: WO2018/020923
PCT Pub. Date: Feb. 1, 2018

(65) Prior Publication Data

US 2019/0271284 A1 Sep. 5, 2019

(30) Foreign Application Priority Data

Jul. 27, 2016 (JP) ..... 2016-147794

(51) Int. Cl.
*F02M 25/08* (2006.01)
*F02M 35/10* (2006.01)

(52) U.S. Cl.
CPC ..... *F02M 25/0818* (2013.01); *F02M 25/08* (2013.01); *F02M 25/089* (2013.01);
(Continued)

(58) Field of Classification Search
CPC ..... F02M 25/0809; F02M 25/0818; F02M 25/08; F02M 25/0836; F02M 25/089; F02M 35/10222
See application file for complete search history.

(56) References Cited

U.S. PATENT DOCUMENTS 5,592,923 A 1/1997 Machida
6,148,803 A 11/2000 Majima et al.
(Continued)

FOREIGN PATENT DOCUMENTS

CN 103270286 A 8/2013
JP H8-061163 A 3/1996
(Continued)

OTHER PUBLICATIONS

International Search Report (ISR) for PCT/JP2017/023268 dated Sep. 5, 2017 (2 pages).
(Continued)

*Primary Examiner* — Gonzalo Laguarda
(74) *Attorney, Agent, or Firm* — Shumaker, Loop & Kendrick, LLP

(57) ABSTRACT

An evaporated fuel processing may include: a canister disposed on a purge passage; a control valve disposed on the purge passage between an intake passage and the canister and switching between communication and cutoff states, the communication state where the canister and the intake passage communicate through the purge passage, and the cutoff state where communication between the canister and the intake passage is cut off on the purge passage; a pressure detector detecting a pressure in the purge passage on a canister side relative to the control valve; and a determining unit determining whether clogging is occurring in the purge passage between the control valve and the intake passage by using a difference between a pressure under the communication state and a pressure under the cutoff state that are detected by the pressure detector while the control valve repeatedly switches between the communication state and the cutoff state.

7 Claims, 8 Drawing Sheets

(52) U.S. Cl.
CPC .. *F02M 25/0836* (2013.01); *F02M 35/10222* (2013.01); *F02M 25/0809* (2013.01)

(56) References Cited

U.S. PATENT DOCUMENTS

| | | | | |
|---|---|---|---|---|
| 6,604,407 | B2 | 8/2003 | Kano et al. | |
| 6,736,117 | B2 * | 5/2004 | Isobe | F02M 25/0809 123/520 |
| 8,104,333 | B2 | 1/2012 | Takakura | |
| 8,392,098 | B2 | 3/2013 | Yamashita | |
| 9,163,590 | B2 * | 10/2015 | Takeishi | F02M 25/0809 |
| 9,297,717 | B2 | 3/2016 | Haag et al. | |
| 9,353,707 | B2 | 5/2016 | Kimura | |
| 9,494,481 | B2 | 11/2016 | Takakura | |
| 9,689,351 | B2 * | 6/2017 | Ono | F02M 25/0836 |
| 10,100,757 | B2 * | 10/2018 | Pursifull | F02M 25/089 |
| 2016/0017849 | A1 | 1/2016 | Shirai | |

FOREIGN PATENT DOCUMENTS

| | | | |
|---|---|---|---|
| JP | H11-210568 | A | 8/1999 |
| JP | 2002-364465 | A | 12/2002 |
| JP | 2007-247455 | A | 9/2007 |
| JP | 2009-293615 | A | 12/2009 |
| JP | 2011-027073 | A | 2/2011 |
| JP | 2013-160108 | A | 8/2013 |
| JP | 2013-185528 | A | 9/2013 |
| JP | 2014-181653 | A | 9/2014 |
| JP | 2016-020675 | A | 2/2016 |

OTHER PUBLICATIONS

English Translation of International Preliminary Examination Report (IPER) for PCT/JP2017/023268 dated Apr. 11, 2018 (4 pages).
Chinese Office Action (CN OA) for CN Pat. App. No. 201780045878.9 dated Jun. 1, 2020 (15 pages including English translation).

* cited by examiner

EVAPORATED FUEL TREATMENT DEVICE

TECHNICAL FIELD

The description herein discloses an evaporated fuel processing device configured to supply evaporated fuel generated in a fuel tank to an engine through an intake passage of the engine.

BACKGROUND ART

An evaporated fuel processing device is provided with a canister configured to adsorb and store evaporated fuel generated in a fuel tank, and a control valve disposed on a purge passage connecting the canister and an intake passage. The control valve switches between a communication state where the canister communicates with the intake passage and a cutoff state where they do not communicate. In a case where the control valve is in the communication state, purge gas in which the evaporated fuel in the canister and air are mixed is supplied to an engine through the purge passage and the intake passage. Hereinbelow, a process to set the control valve in the communication state to allow the purge gas flow will be termed a purge process.

Although different from an evaporated fuel processing device, Japanese Patent Application Publication No. 2011-27073 describes a technique that determines whether or not clogging is occurring in a blowby gas passage in a system that supplies blowby gas to an intake passage. The blowby gas is gas that leaks out to a crank casing from between a piston and a cylinder in an engine.

The blowby gas passage communicates, from the crank casing, with the intake passage on a downstream side relative to a throttle valve. An intake amount suctioned to the intake passage varies as the throttle valve opens and closes. When an opening area of the passage through which the blowby gas flows from the crank casing to the intake passage decreases, variation in the intake amount caused by opening and closing of the throttle valve becomes smaller. Japanese Patent Application Publication No. 2011-27073 determines whether or not clogging is occurring in the passage through which the blowby gas flows based on the variation in the intake amount caused by the opening and closing of the throttle valve.

SUMMARY

Technical Problem

In an evaporated fuel processing device, when clogging occurs in a purge passage, sufficient purge gas does not be supplied to an intake passage. As such, evaporated fuel excessively stagnates in a canister when clogging occurs in the purge passage, which may result in a situation in which the canister cannot store the evaporated fuel any more. The description herein provides a technique to detect clogging in a purge passage.

Solution to Technical Problem

The technique disclosed herein relates to an evaporated fuel processing device. The evaporated fuel processing device is used to supply evaporated fuel generated in a fuel tank to an intake passage of an engine through a purge passage communicating between the fuel tank and the intake passage. The evaporated fuel processing device may comprise: a canister disposed on the purge passage and configured to adsorb the evaporated fuel in the fuel tank; a control valve disposed on the purge passage between the intake passage and the canister, and configured to switch between a communication state and a cutoff state, the communication state being a state where the canister and the intake passage communicate through the purge passage, and the cutoff state being a state where communication between the canister and the intake passage is cut off on the purge passage: a pressure detector configured to detect a pressure in the purge passage on a canister side relative to the control valve; and a determining unit configured to determine whether clogging is occurring in the purge passage between the control valve and the intake passage by using a difference between a pressure under the communication state and a pressure under the cutoff state that are detected by the pressure detector while the control valve repeatedly switches between the communication state and the cutoff state.

In this configuration, the purge passage from the intake passage to the control valve (hereinbelow termed a "downstream-side purge passage") is communicated in a case where no clogging is occurring in the purge passage. Due to this, the pressure in the downstream-side purge passage matches the pressure in the intake passage. Further, in a case where the control valve is in the cutoff state, the purge passage from the canister to the control valve (hereinbelow termed an "upstream-side purge passage") is not communicated with the intake passage, and thus has a pressure different from that of the downstream-side purge passage. For example, in a case where the upstream-side purge passage is communicated with open air through the canister, the pressure in the upstream-side purge passage matches an atmospheric pressure. Alternatively, in a case where a pressure of the purge gas in the upstream-side purge passage is increased by a pump or the like, the pressure in the upstream-side purge passage becomes a positive pressure.

In the evaporated fuel processing device, by using the pressure difference between the upstream-side purge passage and the downstream-side purge passage in a case where the control valve is in the cutoff state, the purge gas is supplied to the intake passage from the upstream-side purge passage through the downstream-side purge passage upon switching of the control valve from the cutoff state to the communication state.

As aforementioned, due to the presence of the pressure difference between the upstream-side purge passage and the downstream-side purge passage, the pressure in the upstream-side purge passage drastically changes upon the switching of the control valve from the cutoff state to the communication state. When the control valve is repeatedly switched between the cutoff state and the communication state, the pressure change in the upstream-side purge passage continuously occurs. However, if clogging is occurring in the downstream-side purge passage, the pressure in the downstream-side purge passage is not uniformized with the pressure in the intake passage, as a result of which the pressure difference between the downstream-side purge passage and the upstream-side purge passage decreases upon the switching of the control valve from the cutoff state to the communication state. As a result, the pressure change in the upstream-side purge passage is small even when the control valve is repeatedly switched between the cutoff state and the communication state. Due to this, the determination that the clogging is occurring in the purge passage may be made by using the pressure change in the upstream-side purge passage.

A compressor may be disposed on the intake passage. The evaporated fuel processing device may further comprise a pump disposed on the purge passage that is on the canister side relative to the pressure detector. The determining unit may be configured to determine whether clogging is occurring in the purge passage between the control valve and the intake passage by using the difference between the pressure under the communication state and the pressure under the cutoff state that are detected by the pressure detector while the control valve repeatedly switches between the communication state and the cutoff state and the pump is driven. According to this configuration, the pressure in the upstream-side purge passage may be increased by an operation of the pump. As a result, the purge gas may smoothly be supplied to the intake passage in the purge process. Further, by increasing the pressure in the upstream-side purge passage, the difference from the pressure in the downstream-side purge passage may be made large in a case where no clogging is occurring in the purge passage. Due to this, it is possible to make a large difference between a pressure change in the upstream-side purge passage in the case where clogging is occurring in the purge passage and a pressure change in the upstream-side purge passage in the case where no clogging is occurring in the purge passage upon the switching of the control valve between the communication state and the cutoff state. Due to this, the determination on the clogging in the purge passage may easily be made.

The purge passage may connect to the intake passage on an upstream side relative to the compressor. In a state where the compressor is driven, a positive pressure is generated in the intake passage on a downstream side relative to the compressor. By connecting the purge passage to the intake passage on the upstream side relative to the compressor, the purge gas may smoothly be supplied to the intake passage that is maintained at substantially an atmospheric pressure while the compressor is driven.

The purge passage may branch at an intermediate position from the control valve toward the intake passage, one of the purge passage may connect to the intake passage on the upstream side relative to the compressor, and other of the purge passage may connect to the intake passage on a downstream side relative to the compressor. The determining unit may be configured to determine whether clogging is occurring in the one of the purge passage by using the difference between the pressure under the communication state and the pressure under the cutoff state that are detected by the pressure detector while the control valve repeatedly switches between the communication state and the cutoff state, the pump is driven, and the compressor is driven. According to this configuration, the purge gas may be supplied to the intake passage on the upstream side relative to the compressor (that is, the intake passage having a substantially atmospheric pressure) while the compressor is driven, and the purge gas may be supplied to the intake passage on the downstream side relative to the compressor (that is, the intake passage having a negative pressure) while the compressor is not driven. Further, by operating the pump while the compressor is driven, a pressure difference may be generated between the upstream and downstream sides relative to the control valve. Due to this, the determination that the clogging is occurring in the purge passage may be made.

The purge passage may branch at an intermediate position from the control valve toward the intake passage, one of the purge passage may connect to the intake passage on the upstream side relative to the compressor, and other of the purge passage may connect to the intake passage on a downstream side relative to the compressor. The determining unit may be configured to determine whether clogging is occurring in the other of the purge passage by using the difference between the pressure detected under the communication state and the pressure under the cutoff state that are detected by the pressure detector while the control valve repeatedly switches between the communication state and the cutoff state and the compressor is not driven. According to this configuration, a determination that the clogging is occurring in the other purge passage may be made.

DETAILED DESCRIPTION

First Embodiment

Figure 1:
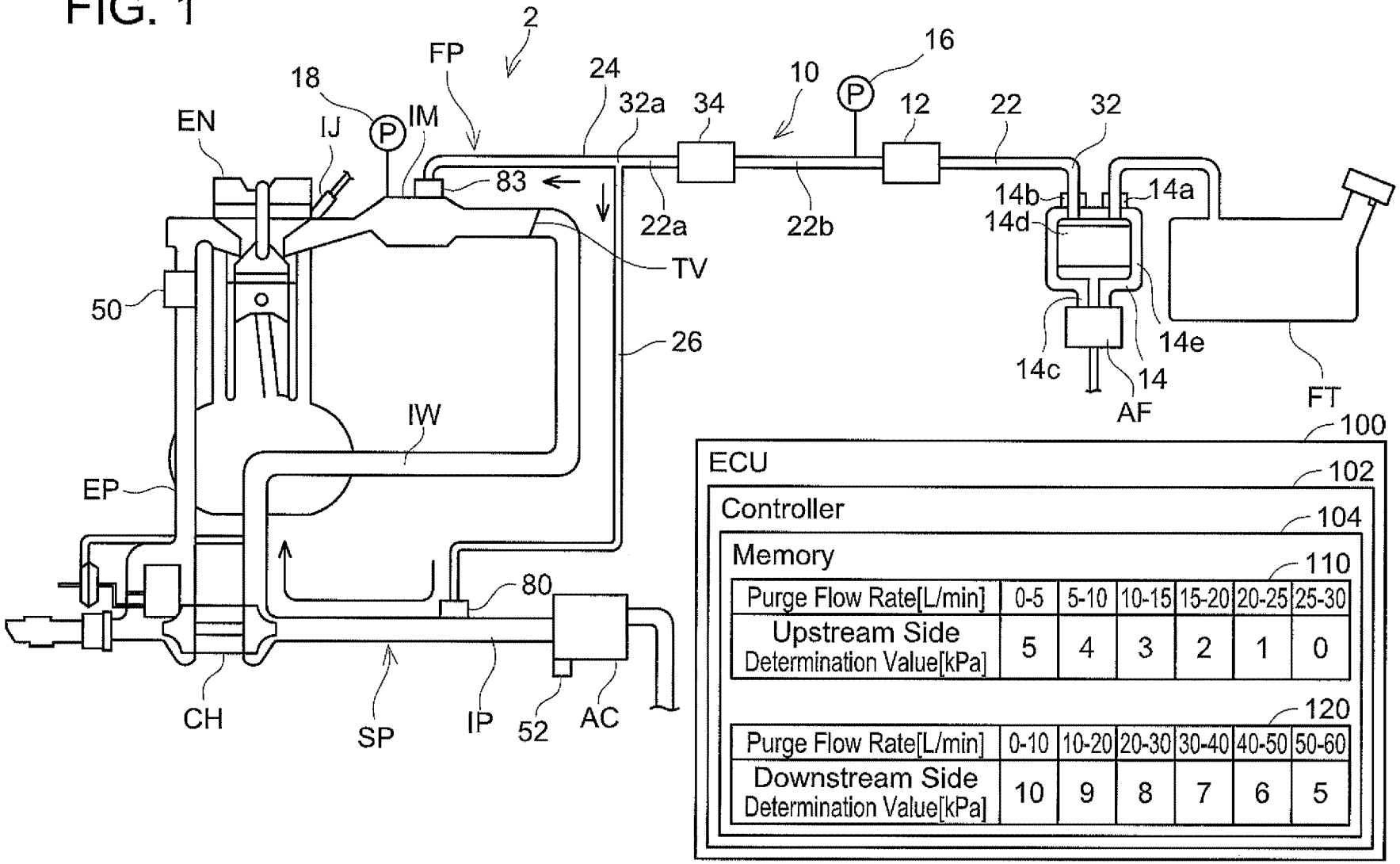
FIG. 1 shows an overview of a fuel supply system according to a first embodiment.

An evaporated fuel processing device 10 will be described with reference to the drawings. As shown in FIG. 1, the evaporated fuel processing device 10 is mounted on a vehicle such as an automobile, and is disposed in a fuel supply system 2 configured to supply fuel stored in a fuel tank FT to an engine EN.

The fuel supply system 2 is configured to supply the fuel pumped from a fuel pump (not shown) accommodated in the fuel tank FT to an injector IJ. The injector IJ includes a solenoid valve of which divergence is adjusted by an ECU (Engine Control Unit) 100 to be described later. The injector IJ is configured to inject the fuel to the engine EN. The ECU 100 is configured to adjust the divergence of the injector IJ to adjust a fuel supply amount to the engine EN.

The engine EN has an intake pipe IP and an exhaust pipe EP connected thereto. The intake pipe IP is a pipe for supplying air to the engine EN by a negative pressure of the engine EN or an operation of a compressor CH. A throttle valve TV is disposed on the intake pipe IP. The throttle valve TV is configured to control an amount of air flowing into the engine EN (that is, an intake amount) by adjusting a divergence of the intake pipe IP. The throttle valve TV is controlled by the ECU 100. The compressor CH is disposed on the intake pipe IP on an upstream side relative to the throttle valve TV. The compressor CH is a so-called turbocharger, which rotates a turbine by gas discharged to the exhaust pipe EP from the engine EN to compress air in the intake pipe IP, and supplies the same to the engine EN. The compressor CH is controlled by the ECU 100 so that it starts operating when a number of revolutions N of the engine EN exceeds a predetermined number of revolutions (such as 2500 revolutions).

An air cleaner AC is disposed on the intake pipe IP on the upstream side relative to the compressor CH. The air cleaner AC includes a filter for removing foreign matters from air flowing into the intake pipe IP. When the throttle valve TV opens, air is suctioned in the intake pipe IP through the air cleaner AC toward the engine EN. The engine EN combusts the fuel and the air therein, and discharges exhaust gas to the exhaust pipe EP after the combustion.

In a state where the compressor CH is not driven, a negative pressure is generated in the intake pipe IP by driving of the engine EN. In a case where idling of the engine EN is stopped while the automobile is stopped or the engine EN is stopped and a motor is used as a locomotive drive such as in a hybrid vehicle, in other words, in a case where the driving of the engine EN is controlled for environmental purposes, the negative pressure in the intake pipe IP by the driving of the engine EN is not generated or small. On the other hand, in a state where the compressor CH is driven, the upstream side relative to the compressor CH is at an atmospheric pressure, while a positive pressure is generated on a downstream side relative to the compressor CH.

The evaporated fuel processing device 10 supplies evaporated fuel in the fuel tank FT to the engine EN through the intake pipe IP. The evaporated fuel processing device 10 includes a canister 14, a pump 12, a purge pipe 32, a control valve 34, a controller 102 in the ECU 100, check valves 80, 83, and pressure sensors 16, 18. The canister 14 is configured to store the evaporated fuel generated in the fuel tank FT. The canister 14 includes an active charcoal 14*d* and a casing 14*e* that houses the active charcoal 14*d*. The casing 14*e* includes a tank port 14*a*, a purge port 14*b*, and an air port 14*c*. The tank port 14*a* is connected to an upper end of the fuel tank FT. Due to this, the evaporated fuel in the fuel tank FT flows into the canister 14. The active charcoal 14*d* adsorbs the evaporated fuel from gas flowing into the casing 14*e* from the fuel tank FT. Due to this, the evaporated fuel can be prevented from being discharged to open air.

The air port 14*c* communicates with open air via an air filter AF. The air filter AF removes foreign matters from air flowing into the canister 14 through the air port 14*c*.

The purge pipe 32 is connected to the purge port 14*b*. Gas containing the evaporated fuel (hereinbelow termed "purge gas") in the canister 14 flows into the purge pipe 32 from the canister 14 through the purge port 14*b*. The purge pipe 32 defines purge passages 22, 24, 26. The purge gas in the purge pipe 32 flows through the purge passages 22, 24, 26 and is supplied to an intake passage IW.

The purge pipe 32 branches into two at a branching position 32*a* between the canister 14 and the intake passage IW. One of the branches of the purge pipe 32 is connected to an intake manifold IM on an engine EN side (that is, on a downstream side) relative to the throttle valve TV and the compressor CH, and the other of the branches of the purge pipe 32 is connected to an air cleaner AC side (that is, on an upstream side) relative to the throttle valve TV and the compressor CH. The purge passage 22 is defined by the purge pipe 32 on a canister 14 side relative to the branching position 32*a*, the purge passage 24 is defined by the purge pipe 32 connected on the downstream side from the branching position 32*a* of the purge pipe 32, and the purge passage 26 is defined by the purge passage 32 connected on the upstream side from the branching position 32*a* of the purge pipe 32.

The pump 12 is disposed at an intermediate position on the purge passage 22. The pump 12 is a so-called vortex pump (which may also be termed a cascade pump or a Wesco pump), or a centrifugal pump. The pump 12 is controlled by the controller 102. A suction inlet of the pump 12 is connected to the canister 14 via the purge passage 22.

A discharge outlet of the pump 12 is connected to the purge pipe 32. The pump 12 pumps out the purge gas to the purge passage 22. The purge gas pumped out into the purge passage 22 flows through the purge passage 24 or the purge passage 26 and is supplied to the intake passage IW.

The check vale 83 is disposed at an end of the purge passage 24 on an intake passage IW side. The check valve 83 is configured to allow gas to flow from the purge passage 24 toward the intake passage IW and prohibit it from flowing from the intake passage IW toward the purge passage 24. The check valve 80 is disposed at an end of the purge passage 26 on the intake passage IW side. The check valve 80 is configured to allow gas to flow from the purge passage 26 toward the intake passage IW and prohibit it from flowing from the intake passage IW toward the purge passage 26.

The control valve 34 is disposed on the purge passage 22 between the pump 12 and the branching position 32*a*. In a case where the control valve 34 is in a closed state, the purge passage 22 is closed, and the purge gas in the purge passage 22 is stopped by the control valve 34 and thus does not flow toward the intake passage IW. On the other hand, when the control valve 34 opens, the purge passage 22 opens, and the purge gas flows toward the intake passage IW. The control valve 34 is an electronic control valve, and is controlled by the controller 102. Hereinbelow, the purge passage 22 on an upstream side relative to the control valve 34 will be termed "purge passage 22*b*", and the purge passage 22 on a downstream side relative to the control valve 34 will be termed "purge passage 22*a*".

The pressure sensor 16 is disposed on the purge passage 22*b* between the control valve 34 and the pump 12. The pressure sensor 16 is configured to detect a pressure in the purge passage 22*b*. Further, the pressure sensor 18 is disposed at the intake manifold IM. The pressure sensor 18 detects a pressure in the intake manifold IM.

The controller 102 is a part of the ECU 100, and is disposed integrally with other units of the ECU 100 (for example, a unit configured to control the engine EN). The controller 102 may be disposed separately from the other units of the ECU 100. The controller 102 includes a CPU and a memory 104 such as a ROM and a RAM. The controller 102 is configured to control the evaporated fuel processing device 10 according to a program that is stored in the memory 104 in advance. Specifically, the controller 102 outputs a signal to the pump 12 and thereby controls the pump 12. Further, the controller 102 outputs a signal to the control valve 34 and executes a duty control thereon. That is, the controller 102 is configured to control an opening time of the control valve 34 by adjusting a duty ratio of the signal outputted to the control valve 34.

The memory 104 stores data maps 110, 120 in advance. In the data map 110, a flow rate of the purge gas which is expected to pass through the control valve 34 in the purge process (hereinbelow termed "expected purge flow rate") and an upstream-side determination value are associated with each other. The upstream-side determination value is used in determining whether or not clogging is occurring in the purge passages 22*a*, 26 in an upstream clogging determination process to be described later. In the data map 120, the expected purge flow rate and a downstream-side determination value are associated with each other. The downstream-side determination value is used in determining whether or not clogging is occurring in the purge passages 22*a*, 24 in a downstream clogging determination process to be described later. The data maps 110, 120 are specified by experiments in advance, and are stored in the memory 104.

The ECU 100 is connected to an air-fuel ratio sensor 50 disposed in the exhaust pipe EP. The ECU 100 is configured to detect an air-fuel ratio in the exhaust pipe EP from a detection result of the air-fuel ratio sensor 50, and control a fuel injection amount from the injector IJ.

Further, the ECU 100 is connected to an air flowmeter 52 disposed near the air cleaner AC. The air flowmeter 52 is a so-called hot-wire air flowmeter, however, it may be of another type. The ECU 100 is configured to receive a signal indicating a detection result from the air flowmeter 52 and detect a gas amount (that is, an intake amount) suctioned to the engine EN.

Next, the purge process of supplying the purge gas from the canister 14 to the intake passage IW will be described. When a purge condition is satisfied while the engine EN is driving, the controller 102 executes the purge process by performing duty control on the control valve 34. The purge condition is a condition that is satisfied in a case where the purge process of supplying the purge gas to the engine EN should be executed, and is a condition that is set in advance in the controller 102 by a manufacturer according to specific situations regarding a cooling water temperature in the engine EN and a purge concentration. The controller 102 is constantly monitoring whether or not the purge condition is satisfied while the engine EN is driving.

In the purge process, the purge gas is supplied from the canister 14 to the intake passage IW on the downstream side relative to the throttle valve TV through the purge passages 22, 24, or from the canister 14 to the intake passage IW on the upstream side relative to the compressor CH through the purge passages 22, 26. Which one of the above passages is to be used for the purge gas supply depends on a pressure in the intake manifold IM. The pressure in the intake manifold IM changes depending on whether or not the compressor CH is driven.

In a case where the compressor CH is not driven, the intake manifold IM has a negative pressure due to the engine EN being driven. On the other hand, the intake passage IW on the upstream side relative to the throttle valve TV is substantially at the atmospheric pressure. As a result, the purge gas is primarily supplied from the canister 14 to the intake passage IW in the intake manifold IM through the purge passages 22, 24. A passage through which the purge gas is supplied to the engine EN from the control valve 34 through the purge passages 22*a*, 24 and the intake passage IW will be termed a first purge passage FP.

On the other hand, the downstream side relative to the compressor CH is compressed by the compressor CH while the compressor CH is driven. Due to this, the pressure in the intake manifold IM becomes higher than a pressure on the upstream side relative to the compressor CH. As a result, the purge gas is primarily supplied from the canister 14 to the intake passage IW on the upstream side relative to the compressor CH through the purge passages 22, 26. The intake passage IW on the upstream side relative to the compressor CH has a pressure which is approximated to the atmospheric pressure. A passage through which the purge gas is supplied to the engine EN from the control valve 34 through the purge passages 22*a*, 26 and the intake passage IW will be termed a second purge passage SP. The second purge passage SP is longer than the first purge passage FP.

In a case where the controller 102 is to execute the purge process while the compressor CH is driven, the purge gas is supplied primarily to the intake passage IW on the upstream side relative to the compressor CH by pumping out the purge gas using the pump 12. On the other hand, in a case where the controller 102 is to execute the purge process while the compressor CH is not driven, the purge gas is supplied primarily to the intake passage 1W having the negative pressure on the downstream side relative to the throttle valve TV. The controller 102 drives the pump 12 to supply the purge gas to the intake passage IW in a case where the purge gas is not sufficiently supplied to the intake passage IW by the negative pressure in the intake passage IW, due to a large divergence of the throttle valve TV, for example. The controller 102 is configured to drive or stop the pump 12 in accordance with a situation of the negative pressure in the intake passage IW (for example, the number of revolutions of the engine EN).

While the purge process is executed, the fuel supplied from the fuel tank FT through the injector IJ and the evaporated fuel by the purge process are supplied to the engine EN. The controller 102 adjusts an air-fuel ratio of the engine EN to an optimal air-fuel ratio (such as an ideal air-fuel ratio) by adjusting an injection time of the injector IJ and a duty ratio of the control valve 34.

As aforementioned, the purge gas is supplied to the second purge passage SP on the upstream side relative to the compressor CH in the case where the pressure in the intake manifold IM is high. Since the second purge passage SP is substantially at the atmospheric pressure, the controller 102 drives the pump 12 to increase a pressure of the purge gas. As a result, in a case where the control valve 34 is closed and the purge passage 22 is in a cutoff state, the upstream side relative to the control valve 34 has a positive pressure, whereas the downstream side relative to the control valve 34 has the atmospheric pressure. Since the check calve 83 is disposed between the intake manifold IM and the branching position 32*a*, equalization with the pressure on the downstream side relative to the control valve 34 will not occur even if the intake manifold IM has the positive pressure.

In a state where the purge gas is supplied to the second purge passage SP, a pressure difference is generated between the upstream and downstream sides relative to the control valve 34. Due to this, the pressure on the upstream side relative to the control valve 34 repeatedly changes between the positive pressure and the atmospheric pressure in a case where the controller 102 performs the duty control on the control valve 34 and the purge passage 22 is repeatedly switched between a communication state and the cutoff state (see "no clogging" in FIG. 3).

However, if clogging is occurring in the purge passages 22*a*, 26 between the control valve 34 and the intake passage IW, the pressure on the downstream side relative to the control valve 34 is not maintained at the atmospheric pressure and approximates to the pressure on the upstream side relative to the control valve 34. As a result, the pressure change on the upstream side relative to the control valve 34 is small despite the control valve 34 being operated under the duty control (see "clogging" in FIG. 3). The controller 102 executes the upstream clogging determination process for determining whether or not clogging is occurring in the purge passages 22*a*, 26 between the control valve 34 and the intake passage IW based on the pressure change on the upstream side relative to the control valve 34. The controller 102 periodically executes the upstream clogging determination process while the purge process is executed.

Figure 2:
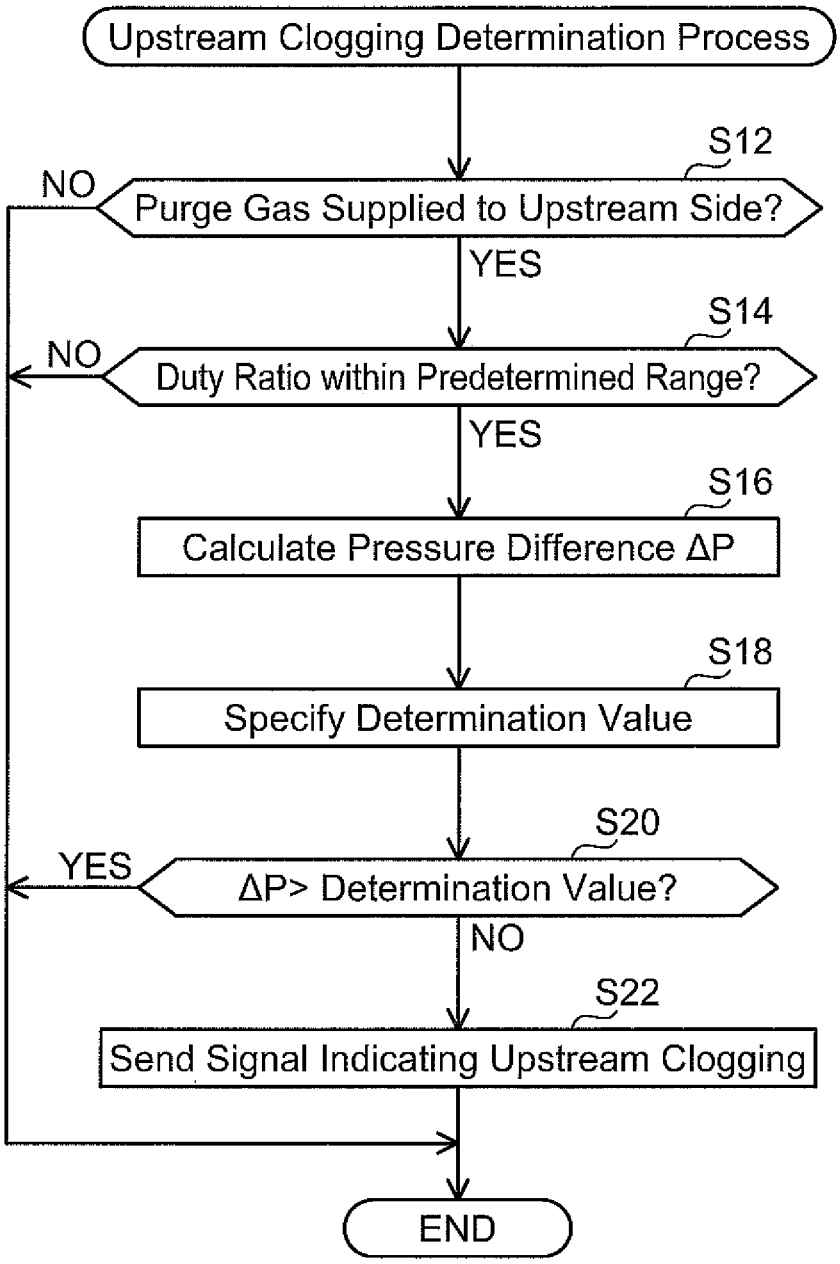
FIG. 2 shows a flowchart of a clogging determination process for an upstream-side purge passage according to the first embodiment.

As shown in FIG. 2, in the upstream clogging determination process, firstly in S12, the controller 102 determines whether or not the purge gas is supplied to the upstream side relative to the compressor CH. Specifically, the controller 102 determines whether or not the compressor CH is driven (that is, the number of revolutions of the engine EN is equal to or greater than a predetermined value). Alternatively, the controller 102 may determine whether or not the pressure in the intake manifold IM is the positive pressure. The controller 102 determines that the purge gas is supplied to the downstream side relative to the compressor CH (NO in S12) in a case where the compressor CH is not driven, and terminates the upstream clogging determination process.

On the other hand, the controller 102 determines that the purge gas is supplied to the upstream side relative to the compressor CH (YES in S12) in a case where the compressor CH is driven, and proceeds to S14. In S14, the controller 102 determines whether or not the duty ratio of the control valve 34 is within a predetermined range (between 20% and 80% inclusive, for example). The duty ratio is a ratio of a period where the control valve 34 is in a communication state (that is, an opened state) per one cycle, which corresponds to one period where the control valve 34 is in the communication state and one period where it is in a cutoff state (that is, a closed state), while the duty control of the control valve 34 to switch it between the communication state and the cutoff state is performed.

In the upstream clogging determination process, the controller 102 determines whether or not clogging is occurring based on the pressure change on the upstream side relative to the control valve 34 that is generated by the pressure difference between the upstream and downstream sides relative to the control valve 34 while the control valve 34 is operated under the duty control (see S20). Due to this, the pressure change on the upstream side relative to the control valve 34 becomes small in both cases where the duty ratio is too large and where it is too small (that is, in both cases where the period of the communication state is too long and where it is too short), by which an appropriate determination on an occurrence of clogging becomes difficult.

Figure 3:
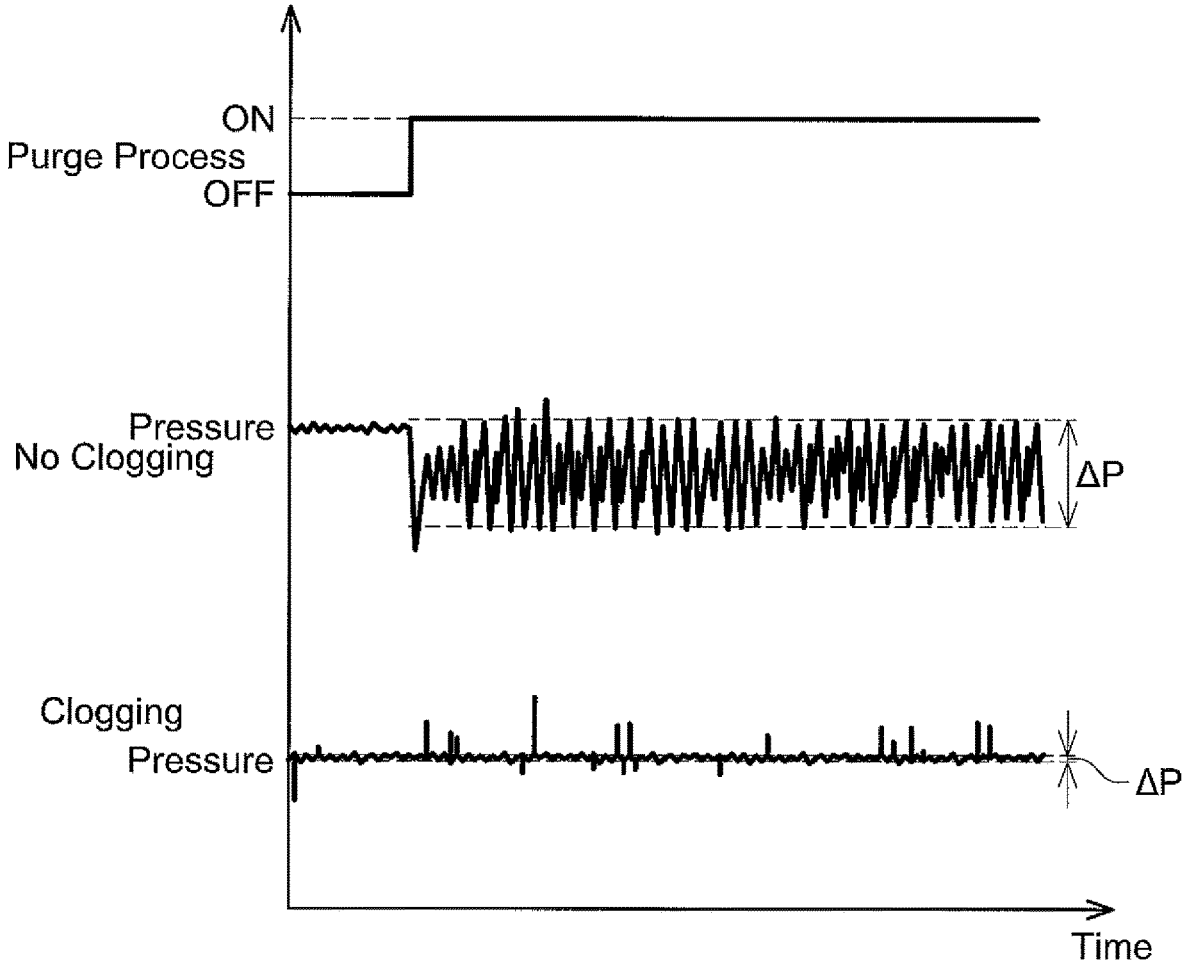
FIG. 3 shows a graph indicating pressure changes on an upstream side relative to a control valve in a case where clogging is occurring and in a case where no clogging is occurring according to the first embodiment.

Thus, in a case where the duty ratio of the control valve 34 is not within the predetermined range (NO in S14), the controller 102 terminates the upstream clogging determination process without determining whether or not clogging is occurring. On the other hand, in a case where the duty ratio of the control valve 34 is within the predetermined range (YES in S14), the controller 102 acquires a pressure difference ΔP for the upstream side relative to the control valve 34 in S16 while the control valve 34 is operated under the duty control. Specifically, as shown in FIG. 3, the controller 102 calculates a difference between an average of high-pressure side pressures (that is, pressures in a case where the purge passage 22 is in the cutoff state by the control valve 34) and an average of low-pressure side pressures (that is, pressures in a case where the purge passage 22 is in the communication state by the control valve 34) that have been detected over plural times by the pressure sensor 16.

Next, in S18, the controller 102 specifies an upstream-side determination value based on an expected purge flow rate that is expected to flow through the control valve 34 per unit time (for example, 1 minute). Specifically, the controller 102 firstly specifies an expected purge flow rate. The controller 102 specifies the expected purge flow rate from a data map (not shown), which is specified in advance by experiments and stored in the memory 104, by using the duty ratio of the control valve 34 and the pressure in the purge passage 22*b* in the case where the purge passage 22 is in the cutoff state by the control valve 34. The expected purge flow rate is a flow rate of the purge gas that is supplied to the intake passage IW through the control valve 34 in a case where no clogging is occurring in the purge passages 22*a*. 26, and therefore if clogging is occurring in the purge passages 22*a*, 26, the flow rate of the purge gas flowing through the control valve 34 is less than the expected purge flow rate.

Next, the specified purge flow rate and the data map 110 are used to specify the upstream-side determination value. For example, in a case where the purge flow rate is greater than 0 litters/min and 5 litters/min or less, the determination value is 5 kPa, and in a case where the purge flow rate is greater than 5 litters/min and 10 litters/min or less, the determination value is 4 kPa. Next, in S20, the controller 102 determines whether or not the pressure difference ΔP specified in S16 is greater than the upstream-side determination value specified in S18. In a case where the pressure difference ΔP is smaller than the determination value (NO in S20), the controller 102 determines that clogging is occurring at somewhere on the purge passages 22*a*, 26, sends a signal indicating that clogging is occurring in the purge passages 22*a*, 26 to a display device of the automobile in S22, and terminates the upstream clogging determination process. In this case, the display device displays information indicating that clogging is occurring in the purge passages 22*a*, 26. Due to this, a driver can acknowledge that clogging is occurring in the purge passages 22*a*. 26.

On the other hand, in a case where the pressure difference ΔP is greater than the determination value (YES in S20), the controller 102 skips S22 and terminates the upstream clogging determination process. FIG. 3 shows the pressure changes in the purge passage 22*b* in both the case where clogging is occurring (that is, "clogging") and the case where no clogging is occurring (that is, "no clogging"). The pressure changes dynamically in the case where no clogging is occurring, whereas the pressure change is small in the case where clogging is occurring. Due to this, in the case where the pressure difference ΔP is greater than the upper-side determination value, it can be determined that no clogging is occurring in the purge passages 22*a*, 26.

Figure 4:
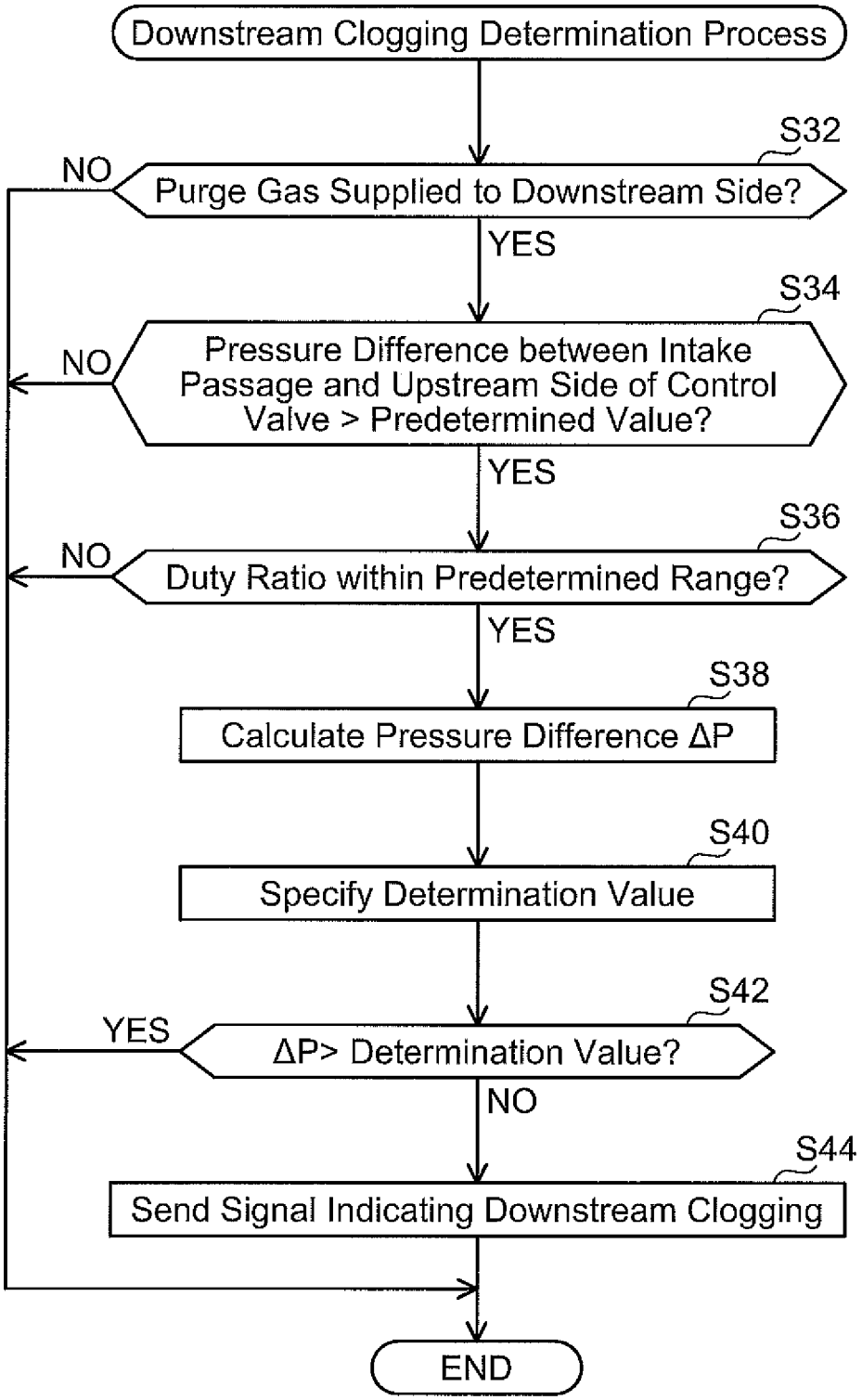
FIG. 4 shows a flowchart of a clogging determination process for a downstream-side purge passage according to the first embodiment.

Subsequent to the upstream clogging determination process, the controller 102 executes the downstream clogging determination process shown in FIG. 4. In the case where the compressor CH is not driven and the purge passage 22 is in the cutoff state, the negative pressure is generated in the intake manifold IM, whereas the upstream side relative to the control valve 34 has a pressure equal to or greater than the atmospheric pressure. Even in a state where the purge gas is supplied to the first purge passage FP, a pressure difference is generated between the upstream and downstream sides relative to the control valve 34. However, when clogging occurs in the purge passage 22*a*, 24 between the control valve 34 and the intake passage IW, the pressure on the downstream side relative to the control valve 34 does not become a negative pressure but approximates to the pressure on the upstream side relative to the control valve 34, as a result of which the pressure difference between the upstream and downstream sides relative to the control valve 34 is small. The controller 102 executes the downstream clogging determination process for determining whether or not clogging is occurring in the purge passages 22*a*, 24 between the control valve 34 and the intake passage IW based on the pressure change on the upstream side relative to the control valve 34 during the purge process. In the downstream clogging determination process, in S32, the controller 102 determines whether or not the purge gas is supplied to the downstream side relative to the compressor CH. Specifically, the controller 102 determines whether or not the compressor CH is not driven (that is, the number of revolutions of the engine EN is equal to or less than the predetermined value). Alternatively, the controller 102 may determine whether or not the pressure in the intake manifold IM is the negative pressure. The controller 102 determines that the purge gas is supplied to the upstream side relative to the compressor CH (NO in S32) in the case where the compressor CH is driven, and terminates the downstream clogging determination process.

On the other hand, the controller 102 determines that the purge gas is supplied to the downstream side relative to the compressor CH (YES in S32) in the case where the compressor CH is not driven, and proceeds to S34. In S34, the controller 102 uses the pressure sensors 16, 18 to determine whether or not a difference between the pressure in the intake passage IW (that is, the intake manifold IM) and the pressure in the purge passage 22*b* is greater than a predetermined value (such as 5 kPa). The pressure in the intake passage IW in the case where the compressor CH is not driven changes according to a drive state of the engine EN. The negative pressure in the intake passage IW may be small depending on the drive state of the engine EN. In this case, the pressure difference between the upstream and downstream sides relative to the control valve 34 is small, so it is difficult to determine whether clogging is occurring based on the pressure difference. Due to this, the controller 102 terminates the downstream clogging determination process in a case where the difference between the pressure in the intake passage IW and the pressure in the purge passage 22*b* is equal to or less than the predetermined value (NO in S34). On the other hand, in a case where the difference between the pressure in the intake passage IW and the pressure in the purge passage 22*b* is greater than the predetermined value (YES in S34), the controller 102 proceeds to S36.

In S36, the controller 102 determines whether or not the duty ratio of the control valve 34 is within the predetermined range (e.g., between 20% and 80% inclusive), similarly to S14 of FIG. 2. In a case where the duty ratio of the control valve 34 is not within the predetermined range (NO in S36), the controller 102 terminates the downstream clogging determination process without determining whether clogging is occurring. On the other hand, in a case where the duty ratio of the control valve 34 is within the predetermined range (YES in S36), the controller 102 acquires a pressure difference ΔP for the purge passage 22*b* on the upstream side relative to the control valve 34 while the control valve 34 is operated under the duty control in S38, similarly to S16.

Next, in S40, the controller 102 specifies a downstream-side determination value based on an expected purge flow rate that is expected to flow through the control valve 34 per unit time (for example, 1 minute). Specifically, the controller 102 firstly specifies an expected purge flow rate. The controller 102 specifies the expected purge flow rate from a data map (not shown), which is specified in advance by experiments and stored in the memory 104, by using the duty ratio of the control valve 34 and the pressure in the intake manifold IM. Then, the controller 102 specifies the downstream-side determination value by using the expected purge flow rate and the data map 120.

Next, in S42, the controller 102 determines whether or not the pressure difference ΔP specified in S38 is greater than the downstream-side determination value specified in S40. In a case where the pressure difference ΔP is smaller than the determination value (NO in S42), the controller 102 determines that clogging is occurring at somewhere on the purge passages 22*a*, 24, sends a signal indicating that clogging is occurring in the purge passages 22*a*, 24 to the display device of the automobile in S44, and terminates the downstream clogging determination process. In this case, the display device displays information indicating that clogging is occurring in the purge passages 22*a*, 24. Due to this, the driver can acknowledge that clogging is occurring in the purge passages 22*a*. 24.

On the other hand, in a case where the pressure difference ΔP is greater than the determination value (YES in S42), the controller 102 skips S44 and terminates the downstream clogging determination process. In the case where the pressure difference ΔP is greater than the determination value, it can be determined that no clogging is occurring in the purge passages 22*a*, 24.

In a variant, one of the upstream clogging determination process and the downstream clogging determination process may not be executed.

Second Embodiment

Figure 5:
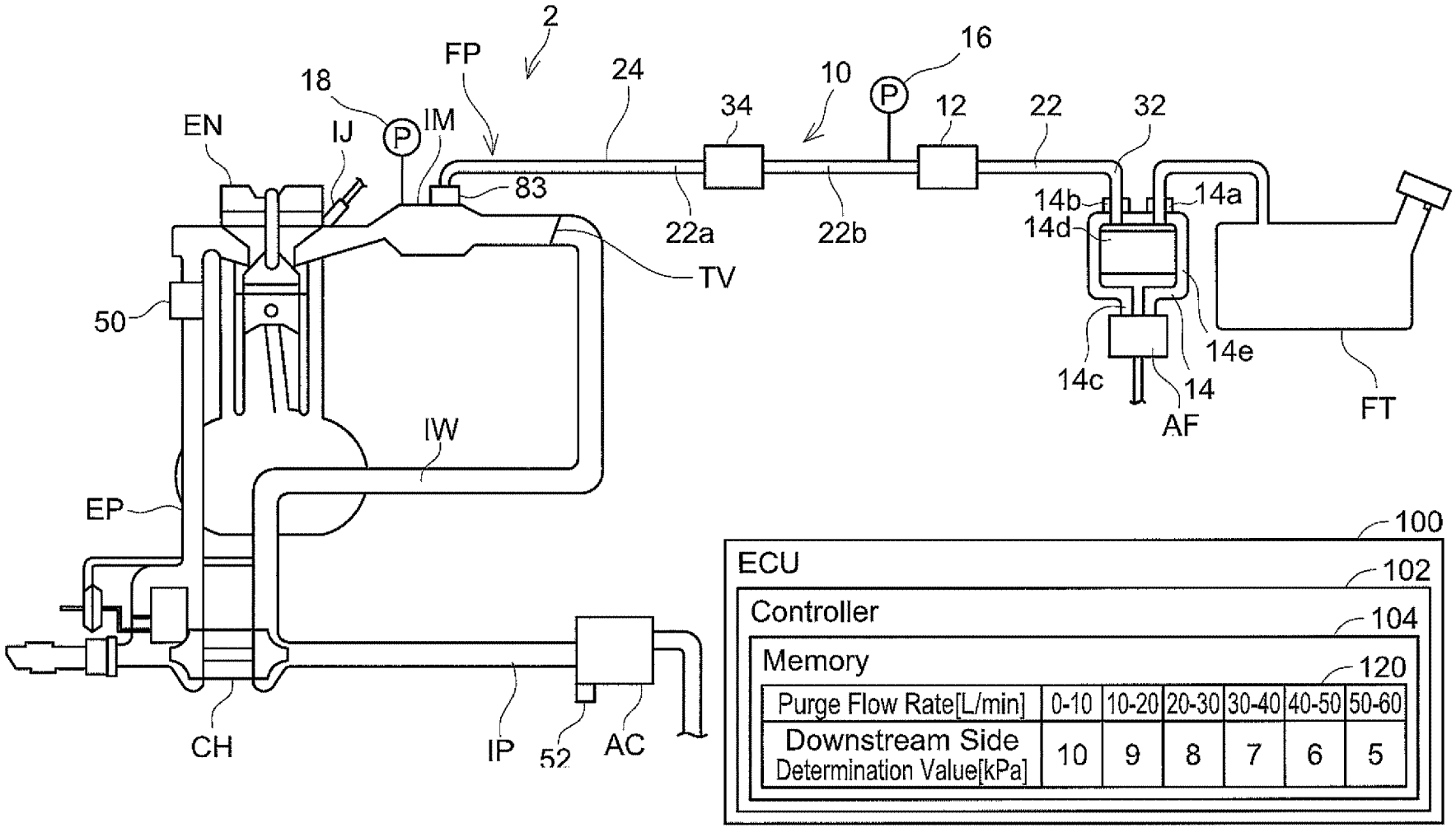
FIG. 5 shows an overview of a fuel supply system of a vehicle according to a second embodiment.

Features that differ from those of the first embodiment will be described. In the present embodiment, as shown in FIG. 5, the second purge passage SP is not provided, and the purge gas is supplied to the intake passage IW only from the first purge passage FP. That is, the purge pipe 32 is not branched, and the purge passage 26 is not provided. In this configuration, the purge process is executed by switching the pump 12 to drive and stop according to the pressure in the intake manifold IM while the compressor CH is not driven, and the purge process is executed by driving the pump 12 while the compressor CH is driven. In a variant, the purge process may not be executed while the compressor CH is driven. In the present embodiment, the controller 102 executes a process similar to the downstream clogging determination process shown in FIG. 4, whereas it does not execute a process similar to the upstream clogging determination process. The memory 104 stores the data map 120, however, it does not store the data map 110. That is, the purge pipe 32 is not branched, and the purge passage 26 is not provided.

Third Embodiment

Figure 6:
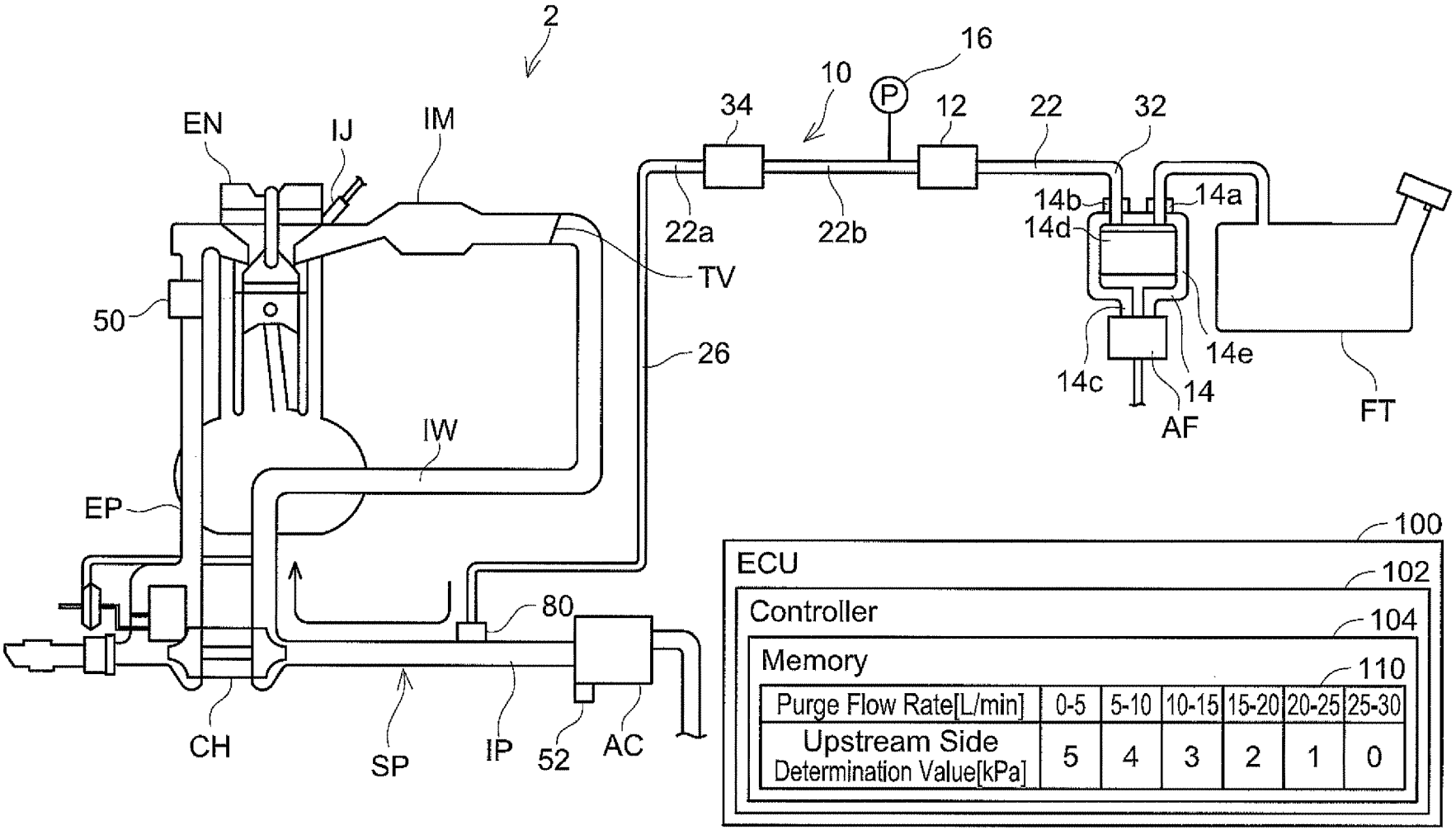
FIG. 6 shows an overview of a fuel supply system of a vehicle according to a third embodiment.

Features that differ from those of the first embodiment will be described. In the present embodiment, as shown in FIG. 6, the first purge passage FP is not provided, and the purge gas is supplied to the intake passage IW only from the second purge passage SP. That is, the purge pipe 32 is not branched, and the purge passage 24 is not provided. Further, the evaporated fuel processing device 10 is not provided with the pressure sensor 18. In this configuration, the pump 12 is driven to execute the purge process for the intake passage IW maintained at the atmospheric pressure. In the present embodiment, the controller 102 executes a process similar to the upstream clogging determination process shown in FIG. 2 whereas it does not execute a process similar to the downstream clogging determination process. The memory 104 stores the data map 110, however, it does not store the data map 120.

Fourth Embodiment

Figure 7:
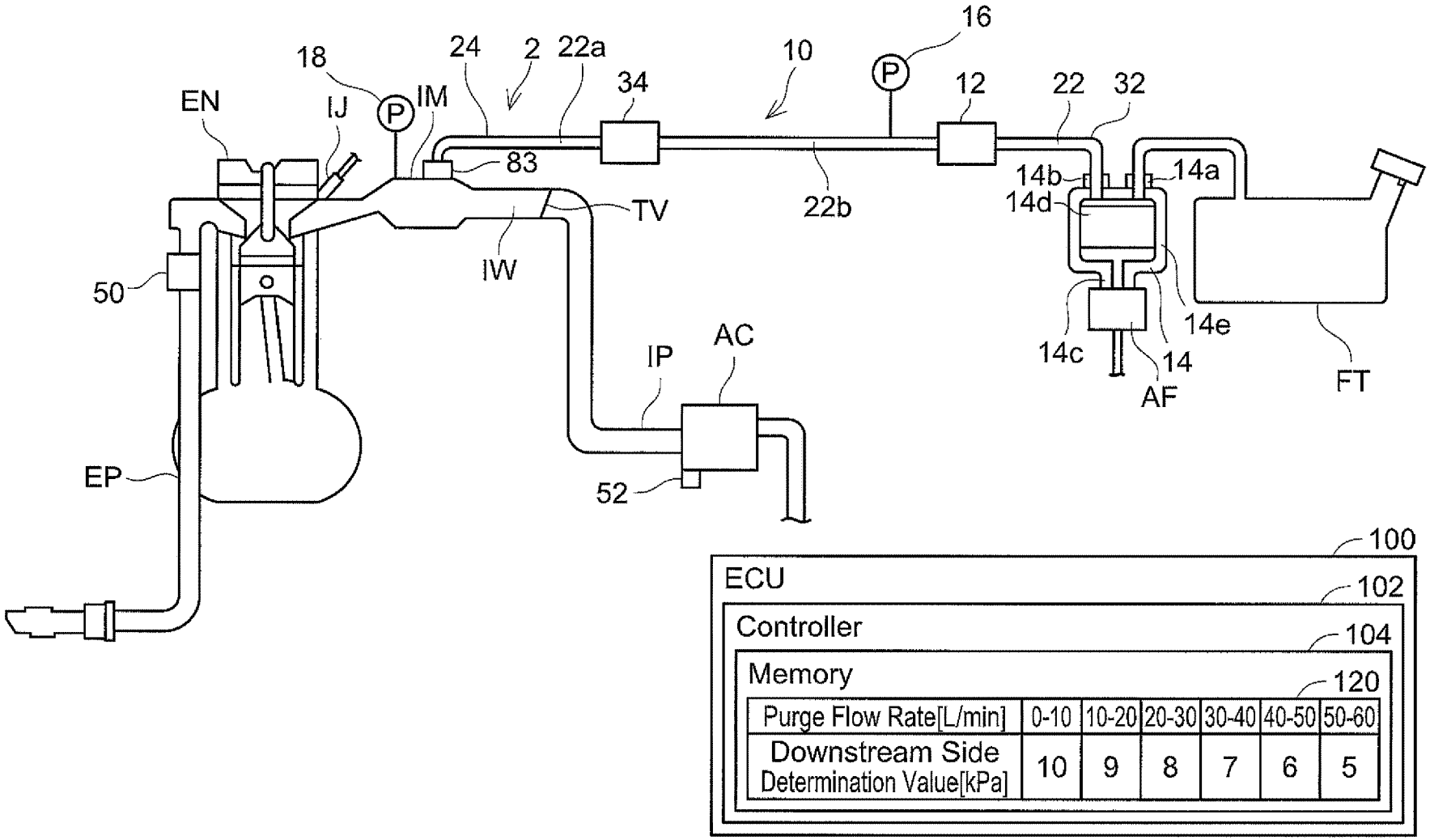
FIG. 7 shows an overview of a fuel supply system of a vehicle according to a fourth embodiment.

Features that differ from those of the first embodiment will be described. In the present embodiment, as shown in FIG. 7, the second purge passage SP is not provided, and the purge gas is supplied to the intake passage IW only from the first purge passage FP. That is, the purge pipe 32 is not branched, and the purge passage 26 is not provided. Further, the compressor CH is not provided on the intake pipe IP. In this configuration, the purge process is executed by switching the pump 12 to drive and stop according to the pressure in the intake manifold IM. In the present embodiment, the controller 102 executes a process similar to the downstream clogging determination process shown in FIG. 4, whereas it does not execute a process similar to the upstream clogging determination process. The memory 104 stores the data map 120, however, it does not store the data map 110.

The pressure in the purge passage 22*b* can be increased by disposing the pump 12 on the purge passage 22. Due to this, as compared to a case where the pump 12 is not provided, the pressure difference ΔP can be made larger. Due to this, the determination on the occurrence of clogging can easily be made. In a variant, the pump 12 may not be provided.

Fifth Embodiment

Figure 8:
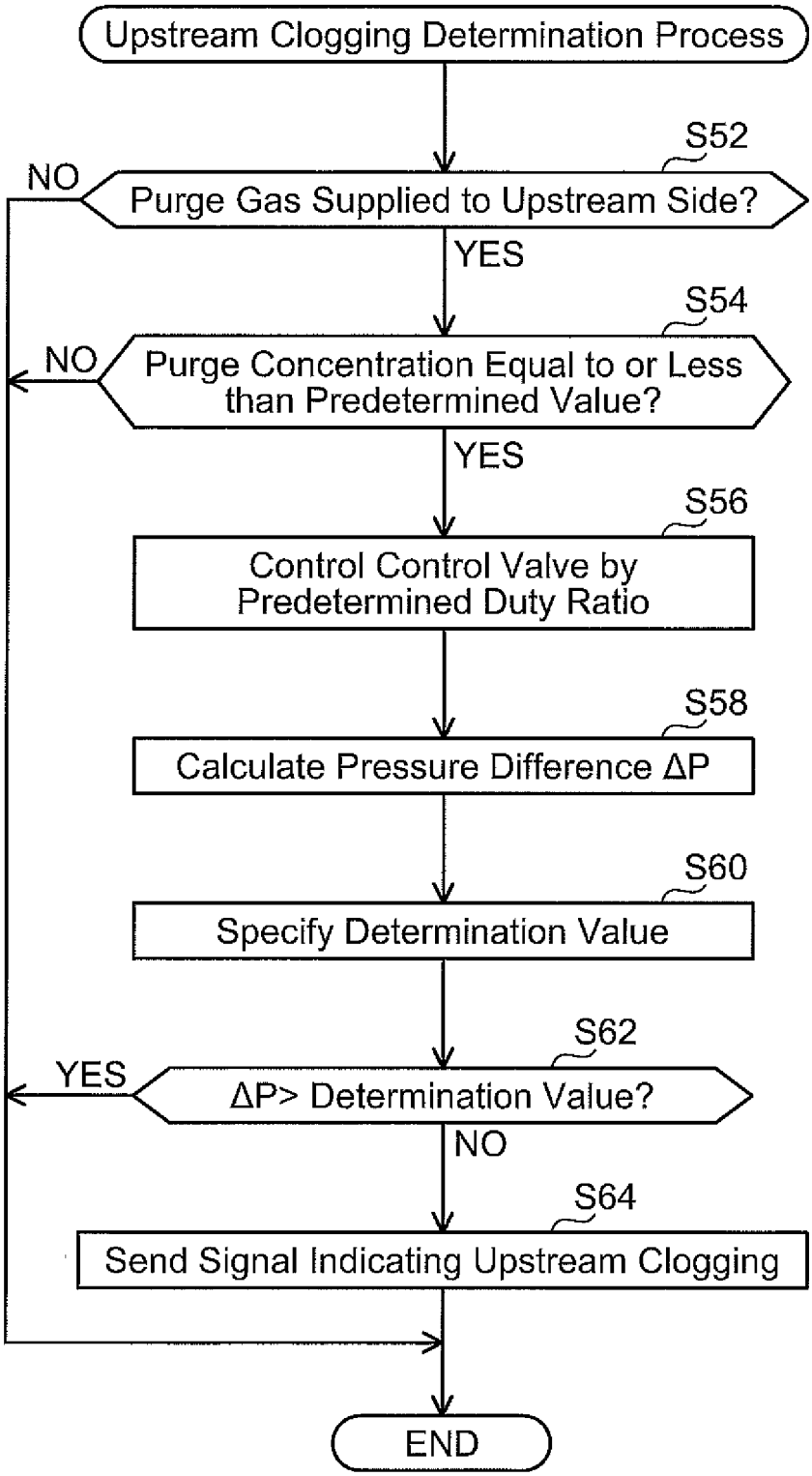
FIG. 8 shows a flowchart of a clogging determination process for an upstream-side purge passage according to a fifth embodiment.

Features that differ from those of the first embodiment will be described. In the present embodiment, an upstream clogging determination process shown in FIG. 8 is executed instead of the upstream clogging determination process of the first embodiment (see FIG. 2). In the upstream clogging determination process of FIG. 8, the duty ratio of the control valve 34 is maintained at a predetermined duty ratio (such as 50%) to determine the occurrence of clogging.

Firstly, in S52, the controller 102 determines whether or not the purge gas is supplied from the upstream side, that is, from the second purge passage SP, similarly to S12 of FIG. 2. In a case where the purge gas is not supplied from the upstream side (NO in S52), the controller 102 terminates the upstream clogging determination process. On the other hand, in a case where the purge gas is supplied from the upstream side (YES in S52), the controller 102 determines whether or not a purge concentration is equal to or less than a predetermined value (such as 10%) in S54. In a case where the purge concentration is greater than the predetermined value (NO in S54), the controller 102 terminates the upstream clogging determination process. On the other hand, in a case where the purge concentration is equal to or less than the predetermined value (YES in S54), the controller 102 maintains the duty ratio of the control valve 34 at the predetermined duty ratio in S56.

If the duty ratio is changed in the case where the purge concentration is high, the evaporated fuel amount supplied to the engine EN by the purge process changes significantly. Due to the possibility of the air-fuel ratio becoming greatly offset by the change in the duty ratio in the case where the purge concentration is high, the controller 102 terminates the upstream clogging determination process without executing the process of S56.

The processes of S16 to S22 of FIG. 2 are executed in the following S58 to S64.

According to this configuration, the control valve 34 can be controlled to be at the duty ratio by which the pressure difference for the purge passage 22*a* can be easily generated to determine clogging.

The upstream clogging determination process of FIG. 8 may be used as a downstream clogging determination process by changing the process in S52. For example, the downstream clogging determination process may be executed by executing the processes of S32, S34 of FIG. 4 as the process of S52.

While specific examples of the present invention have been described above in detail, these examples are merely illustrative and place no limitation on the scope of the patent claims. The technology described in the patent claims also encompasses various changes and modifications to the specific examples described above.

For example, in the respective embodiments as above, the pressure difference ΔP is specified by specifying the pressure in the purge passage 22*a* by the pressure sensor 16. However, the pressure difference ΔP may be specified by using a value of electric current flowing in the pump 12 while the pump 12 is driven. A load on the pump 12 becomes higher as the pressure in the purge passage 22*a* becomes higher. Due to this, while the pump 12 is controlled to rotate at a constant rotation speed, the value of the electric current flowing in the pump 12 changes according to the pressure in the purge passage 22*a*. The controller 102 may determine that clogging is occurring in accordance with a difference in values of the electric current flowing in the pump 12 while the control valve 34 is operated under the duty control. In this case, a data map in which the expected purge flow rate and a determination value related to the electric current value difference are associated may be specified in advance, and be stored in the memory 104. In this variant, the pump 12 is an example of "pressure detector". Alternatively, the pressure difference ΔP may be specified by using a change in the rotation speed of the pump 12 while the pump 12 is driven. While the electric current value is controlled to be constant, the rotation speed of the pump 12 changes according to the pressure change in the purge passage 22*a*. The controller 102 may determine that clogging is occurring in accordance with a difference in the rotation speed of the pump 12 while the control valve 34 is operated under the duty control. In this case, a data map in which the expected purge flow rate and a determination value related to the difference in the pump rotation speed are associated may be specified in advance, and be stored in the memory 104.

Further, for example, in the downstream clogging determination process of FIG. 4, the controller 102 determines whether or not the difference between the pressure in the intake passage IW and the pressure in the purge passage 22*b* is greater than the predetermined value in S34. Instead of this, in S34, the controller 102 may determine whether or not the pressure in the intake passage 1W (that is, the intake manifold IM) is equal to or less than the predetermined value (such as 5 kPa). Further, the controller 102 may determine YES in S34 in a case where the pressure in the intake manifold IM is equal to or less than the predetermined value, and may determine NO in S34 in a case where the pressure in the intake manifold IM is greater than the predetermined value. According to this configuration, it can be avoided to determine that clogging is occurring in a situation where the negative pressure in the intake manifold IM is close to the atmospheric pressure (that is, greater than the predetermined value) and the pressure difference ΔP does not become large despite no clogging being occurring.

Moreover, for example, aside from the control valve 34, the evaporated fuel processing device 10 may be provided with an adjusting valve configured to adjust the supply amount of the purge gas in the case of supplying the purge gas to the engine EN. In this case, the control valve 34 may be switched between the communication state and the cutoff state in the upstream clogging determination process and the downstream clogging determination process, whereas it may be maintained in the communication state in the other occasions. The adjusting valve may be a valve configured to adjust its valve divergence continuously or intermittently. In this case, the supply amount of the purge gas may be adjusted by adjusting the valve divergence. In this case, the controller 102 may maintain the adjusting valve in a fullyopened state in the upstream clogging determination process and the downstream clogging determination process.

The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

REFERENCE SIGNS LIST

2: Fuel Supply System
10: Evaporated Fuel Processing Device
12: Pump
14: Canister
16: Pressure Sensor
18: Pressure Sensor
22: Purge Passage
22*a*: Purge Passage
22*b*: Purge Passage
24: Purge Passage
26: Purge Passage
34: Control Valve
100: ECU
102: Controller
104: Memory
110: Data Map
120: Data Map
CH: Compressor
EN: Engine
FP: First Purge Passage
IM: Intake Manifold
IP: Intake Pipe
IW: Intake Passage
SP: Second Purge Passage

The invention claimed is:

1. An evaporated fuel processing device configured to supply evaporated fuel generated in a fuel tank to an intake passage of an engine through a purge passage communicating between the fuel tank and the intake passage, the evaporated fuel processing device comprising: a canister disposed on the purge passage and configured to adsorb the evaporated fuel in the fuel tank;

a control valve disposed on the purge passage between the intake passage and the canister, and configured to switch between a communication state and a cutoff state, the communication state being a state where the canister and the intake passage communicate through the purge passage, and the cutoff state being a state where communication between the canister and the intake passage is cut off on the purge passage;

a pressure detector configured to detect a pressure in the purge passage on a canister side relative to the control valve;

a determining unit configured to determine whether clogging is occurring in the purge passage between the control valve and the intake passage by using a difference between a plurality of pressures under subsequent communication states and a plurality of pressures under the cutoff state that are detected by the pressure detector while the control valve repeatedly switches between the communication state and the cutoff state; and a controller configured to perform a duty control on the control valve using a duty ratio so as to switch between the communication state and the cutoff state;

wherein a compressor is disposed on the intake passage, the evaporated fuel processing device further comprises a pump disposed on the purge passage that is on the canister side relative to the pressure detector, and the determining unit is configured to determine whether clogging is occurring in the purge passage between the control valve and the intake passage by using the difference between the plurality of pressures under the communication state and the plurality of pressures under the cutoff state that are detected by the pressure detector while the control valve repeatedly switches between the communication state and the cutoff state by the duty control using the duty ratio within a predetermined range and the pump is driven.

2. The evaporated fuel processing device as in claim 1, wherein the purge passage connects to the intake passage on an upstream side relative to the compressor.

3. The evaporated fuel processing device as in claim 1, wherein the purge passage branches at an intermediate position from the control valve toward the intake passage, one of the purge passage connects to the intake passage on the upstream side relative to the compressor, other of the purge passage connects to the intake passage on a downstream side relative to the compressor, and the determining unit is configured to determine whether clogging is occurring in the one of the purge passage by using the difference between the pressure under the communication state and the pressure under the cutoff state that are detected by the pressure detector while the control valve repeatedly switches between the communication state and the cutoff state, the pump is driven, and the compressor is driven.

4. The evaporated fuel processing device as in claim 2, wherein the determining unit is configured to determine whether clogging is occurring in the other of the purge passage by using the difference between the pressure detected under the communication state and the pressure under the cutoff state that are detected by the pressure detector while the control valve repeatedly switches between the communication state and the cutoff state and the compressor is not driven.

5. The evaporated fuel processing device as in claim 1, wherein the determining unit is configured to determine whether clogging is occurring in the purge passage between the control valve and the intake passage by using the difference between the pressure calculated from a plurality of pressures under the communication state and the pressure calculated from a plurality of pressures under the cutoff state that are detected by the pressure detector.

6. An evaporated fuel processing device configured to supply evaporated fuel generated in a fuel tank to an intake passage of an engine through a purge passage communicating between the fuel tank and the intake passage, the evaporated fuel processing device comprising:

a canister disposed on the purge passage and configured to adsorb the evaporated fuel in the fuel tank;

a control valve disposed on the purge passage between the intake passage and the canister, and configured to switch between a communication state and a cutoff state, the communication state being a state where the canister and the intake passage communicate through the purge passage, and the cutoff state being a state where communication between the canister and the intake passage is cut off on the purge passage;

a pressure detector configured to detect a pressure in the purge passage on a canister side relative to the control valve;

a determining unit configured to determine whether clogging is occurring in the purge passage between the control valve and the intake passage by using a difference between a plurality of pressures under subsequent communication states and a plurality of pressures under the cutoff state that are detected by the pressure detector while the control valve repeatedly switches between the communication state and the cutoff state; and a controller configured to perform a duty control on the control valve using a duty ratio so as to switch between the communication state and the cutoff state;

wherein a compressor is disposed on the intake passage, the evaporated fuel processing device further comprises a pump disposed on the purge passage that is on the canister side relative to the pressure detector, and the determining unit is configured to determine whether clogging is occurring in the purge passage between the control valve and the intake passage by using the difference between the plurality of pressures under the communication state and the plurality of pressures under the cutoff state that are detected by the pressure detector while the control valve repeatedly switches between the communication state and the cutoff state by the duty control using the duty ratio that is maintained at a predetermined value and the pump is driven.

7. The evaporated fuel processing device as in claim 6, wherein the determining unit is configured to determine whether clogging is occurring in the purge passage between the control valve and the intake passage by using the difference between the pressure calculated from a plurality of pressures under the communication state and the pressure calculated from a plurality of pressures under the cutoff state that are detected by the pressure detector.

* * * * *